US009296229B1

(12) United States Patent
Fukui et al.

(10) Patent No.: US 9,296,229 B1
(45) Date of Patent: Mar. 29, 2016

(54) PRINTING APPARATUS AND PRINTING METHOD

(71) Applicant: SCREEN Holdings Co., Ltd., Kyoto (JP)

(72) Inventors: Kazuki Fukui, Kyoto (JP); Kazuki Yamanaka, Kyoto (JP); Kunio Muraji, Kyoto (JP); Mitsuhiro Yoshida, Kyoto (JP); Takashi Kamigiku, Kyoto (JP)

(73) Assignees: SCREEN Holdings Co., Ltd. (JP); RICOH COMPANY, LTD. (JP)

( * ) Notice: Subject to any disclaimer, the term of this patent is extended or adjusted under 35 U.S.C. 154(b) by 0 days.

(21) Appl. No.: 14/851,179

(22) Filed: Sep. 11, 2015

(30) Foreign Application Priority Data

Sep. 11, 2014 (JP) ..... 2014-185525

(51) Int. Cl.
*B41J 29/393* (2006.01)
*B41J 15/24* (2006.01)
*B41J 2/01* (2006.01)

(52) U.S. Cl.
CPC ... *B41J 15/24* (2013.01); *B41J 2/01* (2013.01)

(58) Field of Classification Search
CPC ..... B41J 29/393; B41J 11/007; B41J 19/147; B41J 11/42; B41J 19/202; B41J 15/24; B41J 2/01; B41J 29/38
See application file for complete search history.

(56) References Cited

U.S. PATENT DOCUMENTS

| | | | | |
|---|---|---|---|---|
| 8,523,310 | B2 * | 9/2013 | Uchida | B41J 2/1752 347/16 |
| 2002/0034400 | A1 | 3/2002 | Asuwa et al. | 399/165 |
| 2003/0116042 | A1 | 6/2003 | Ohba et al. | 101/225 |
| 2005/0078133 | A1 | 4/2005 | Molinet et al. | 347/12 |
| 2005/0219557 | A1 | 10/2005 | Koike | 358/1.1 |
| 2008/0122889 | A1 | 5/2008 | Naoi et al. | 347/16 |
| 2012/0240803 | A1 | 9/2012 | Sato et al. | 101/485 |
| 2015/0009256 | A1 | 1/2015 | Bildstein et al. | 347/16 |
| 2015/0290931 | A1 | 10/2015 | Boland et al. | |

FOREIGN PATENT DOCUMENTS

| | | |
|---|---|---|
| EP | 2 279 872 A1 | 2/2011 |
| EP | 2 634 003 A1 | 9/2013 |
| JP | 2002-099178 | 4/2002 |

OTHER PUBLICATIONS

Extended European Search Report issued Jan. 28, 2016 in corresponding European Patent Application No. 15184398.4.

* cited by examiner

*Primary Examiner* — Thinh Nguyen
(74) *Attorney, Agent, or Firm* — Ostrolenk Faber LLP

(57) ABSTRACT

In printing apparatus, an edge sensor detects a serpentine amount caused by transportation of a web. A predicted waveform data generating unit generates predicted waveform data on the serpentine amount to be produced in the following web in accordance with actually measured waveform data on the detected serpentine amount. A correcting unit corrects a printing position of an image in accordance with a shift amount, and applies a corrected printing position to a printing head. Here, the shift amount is determined with the shift amount determining unit in accordance with the predicted waveform data. Accordingly, the shift amount is determinable in accordance with the actually measured waveform data on the serpentine amount detected with the edge sensor more accurately than that through a method in which a shift amount is directly determined. This allows suppressed misregister.

9 Claims, 6 Drawing Sheets

PRINTING APPARATUS AND PRINTING METHOD

CROSS-REFERENCE TO RELATED APPLICATIONS

This application claims priority to Japanese Patent Application No. 2014-185525 filed Sep. 11, 2014 the subject matter of which is incorporated herein by reference in entirety.

TECHNICAL FIELD

The present invention relates to a printing apparatus and a printing method for printing images onto a web.

BACKGROUND ART

Examples of such currently-used apparatus include an inkjet printing apparatus (also referred to as an image recorder). The printing apparatus includes a transport mechanism transporting web paper (web), and inkjet heads each discharge ink (ink droplets) onto the web paper to be transported for printing images. For instance, four inkjet heads are provided in a transportation direction of the web paper, and discharge ink in four colors individually for color printing.

The web paper sometimes serpentines when the transport mechanism transports the web paper. Such serpentine web paper causes misregister that an actual printing position is shifted from a target printing position. This causes a color shift that printing positions for different colors shift relative to one another. There has been disclosed a method of performing registration by moving the inkjet heads (printing heads) in accordance with detection values by edge sensors or a method of conform the color shift by shifting printing data for adjusting the misregister or the color shift generated in the above manner. See, for example, Japanese Unexamined Patent Publication No. 2002-099178A. In Japanese Unexamined Patent Publication No. 2002-099178A, a position of forming a latent image by an electro photographic printing apparatus is corrected.

SUMMARY OF INVENTION

Technical Problem

A precise positioning mechanism is required for moving the heads for registering. This leads to an expensive apparatus. Accordingly, another method has been disclosed to perform registration while shifting the print data. On the other hand, when the print data is shifted in a page of the web, a discontinuous part DC in an image (see FIG. 1) caused by the shift becomes remarkable, leading to printing failure. Consequently, the print data is shifted upon start of printing the page, and is not shifted in the page. However, another problem arises that misregister or a color shift becomes large upon completion of printing the page. In addition, with a method in which a shift amount is obtained directly from a serpentine amount of the web actually detected by the sensor, the misregister or the color shift is suppressed insufficiently.

The present invention has been made regarding the state of the art noted above, and its one object is to provide a printing apparatus and a printing method that allow suppression of misregister or a color shift upon printing of an image onto a web transported in a serpentine manner.

Solution to Problem

The present invention is constituted as stated below to achieve the above object. One embodiment of the present invention discloses a printing apparatus printing an image onto a web. The printing apparatus includes a transport mechanism transporting the web; a printing head printing an image onto the web to be transported; a serpentine amount sensor detecting a serpentine amount caused by transportation of the web at a position in which the printing head is disposed or a position therearound; a predicted waveform data generating unit generating predicted waveform data of the serpentine amount to be produced in the following web in accordance with actually measured waveform data on the detected serpentine amount; a shift amount determining unit determining a shift amount of the printing position of the image to be shifted in a width direction of the web, orthogonal to a transportation direction of the web, in a direction in which the predicted serpentine amount is decreased in accordance with the predicted waveform data; and a correcting unit correcting the printing position of the image in accordance with the shift amount and applying a corrected printing position to the printing heads.

With the printing apparatus according to the embodiment of the present invention, the serpentine amount sensor detects the serpentine amount caused by the transportation of the web. The predicted waveform data generating unit generates the predicted waveform data on the serpentine amount to be produced in the following web in accordance with the actually measured waveform data on the detected serpentine amount. The correcting unit corrects the printing positions of the image in accordance with the shift amount, and applies the corrected printing position to the printing head. Here, the shift amount is determined with the shift amount determining unit in accordance with the predicted waveform data. Accordingly, the shift amount is determinable in accordance with the actually measured waveform data on the serpentine amount detected with the serpentine amount sensor more accurately than that with a method using a shift amount directly. This allows suppressed misregister.

Moreover, it is preferable that a plurality of printing heads of the printing apparatus according to the embodiment of the present invention is disposed in the transportation direction of the web, and a plurality of serpentine amount sensors is provided for the printing heads individually. The serpentine amount sensors are provided for the printing heads individually. This allows suppression of the misregister and the color shift in the image printed with the printing heads.

Moreover, it is preferable in the printing apparatus according to the embodiment of the present invention that the actually measured waveform data is composed of differential serpentine amounts obtained by calculating a difference between the serpentine amount detected by one of the serpentine amount sensors and a reference serpentine amount detected with another one of the serpentine amount sensors on either an upstream or downstream side of the one of the serpentine amount sensors in the transportation direction. Specifically, the predicted waveform data generating unit generates the predicted waveform data on the serpentine amounts to be produced in the following web in accordance with the actually measured waveform data composed of the differential serpentine amounts obtained by calculating the difference between the given serpentine amount and the reference serpentine amount. Here, the differential serpentine amount corresponds to a relative amount of the given serpentine amount and the reference serpentine amount. Consequently, the color shift can be suppressed more easily than that when the shift amount is determined only from the given serpentine amount.

Moreover, in the embodiment of the present invention, the predicted waveform data generating unit of the printing apparatus generates the predicted waveform data per page onto which the printing is performed. This allows suppression of the misregister and the color shift per page onto which the printing is performed.

Moreover, in the embodiment of the printing apparatus according to the present invention, the correcting unit corrects the printing position of the image by shifting the printing position with the printing head. Specifically, with an inkjet printing apparatus, the correcting unit performs correction such that ink to be discharged from inkjet nozzles in given positions is discharged from inkjet nozzles shifted in accordance with the shift amount. This achieves correction of the printing position of the image while no image data is changed.

Moreover, in the embodiment of the present invention, the correcting unit of the printing apparatus corrects the printing position of the image by changing a positional relationship in the image data. Specifically, the correcting unit changes the positional relationship in the image data without shifting the printing position with the printing head. This achieves correction of the printing position of the image.

Another embodiment of the present invention discloses a printing method of printing an image onto a web. The printing method includes a serpentine amount detecting step of detecting a serpentine amount caused by transportation of the web by a serpentine amount sensor at a position of a printing head or a position therearound; a predicted wave form data generating step of generating predicted waveform data on the serpentine amount to be produced in the following web by a predicted waveform data generating unit in accordance with actually measured waveform data on the detected serpentine amount; a shift amount determining step of determining a shift amount of the printing position of the image by a shift amount determining unit in a width direction of the web, orthogonal to a transportation direction of the web, in a direction in which the predicted serpentine amount is decreased, in accordance with the predicted waveform data; and a correcting step of correcting the printing position of the image by a correcting unit in accordance with the shift amount and applying a corrected printing position to the printing head.

With the printing method according to the other embodiment of the present invention, the serpentine amount sensor detects the serpentine amount caused by the transportation of the web. The predicted waveform data generating unit generates the predicted waveform data on the serpentine amount to be produced in the following web in accordance with the actually measured waveform data on the detected serpentine amount. The correcting unit corrects the printing position of the image in accordance with the shift amount, and applies the corrected printing position to the printing head. Here, the shift amount is determined by the shift amount determining unit in accordance with the predicted waveform data. Accordingly, the shift amount is obtainable in accordance with the actually measured waveform data on the serpentine amount detected with the serpentine amount sensor more accurately than a shift amount obtained directly. This allows suppressed misregister.

Advantageous Effects of Invention

With the printing apparatus and the printing method according to the embodiments of the present invention, the serpentine amount sensor detects the serpentine amount caused by the transportation of the web. The predicted waveform data generating unit generates the predicted waveform data on the serpentine amount to be produced in the following web in accordance with the actually measured waveform data on the detected serpentine amount. The correcting unit corrects the printing position of the image in accordance with the shift amount, and applies the corrected printing position to the printing head. Here, the shift amount is determined with the shift amount determining unit in accordance with the predicted waveform data. Accordingly, the shift amount is determinable in accordance with the actually measured waveform data on the serpentine amount detected with the serpentine amount sensors more accurately than that through a method in which a shift amount directly determined. This allows suppressed misregister.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

Figure 1:
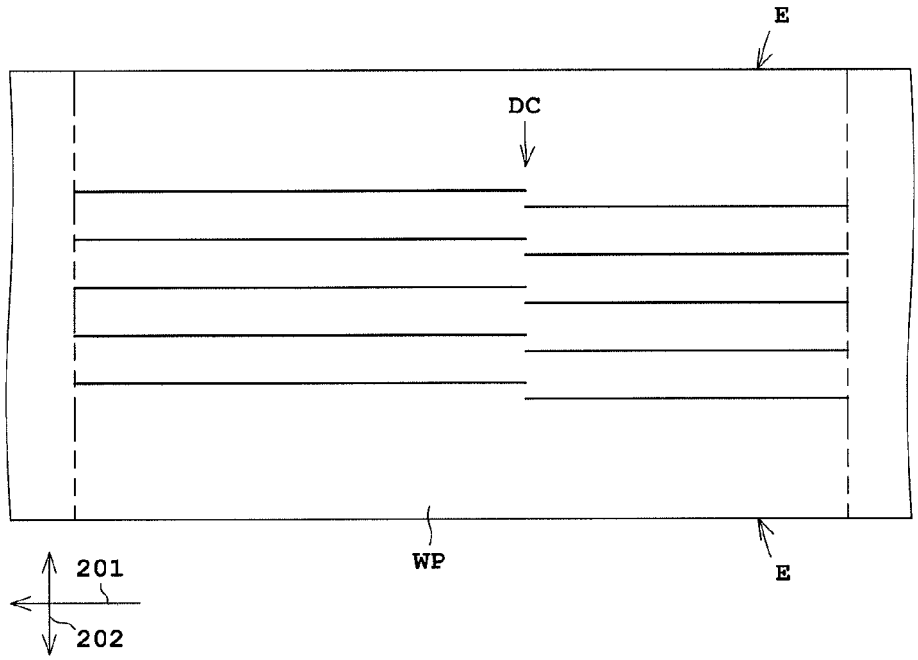
FIG. 1 is an explanatory view of a problem to be solved.
Figure 2:
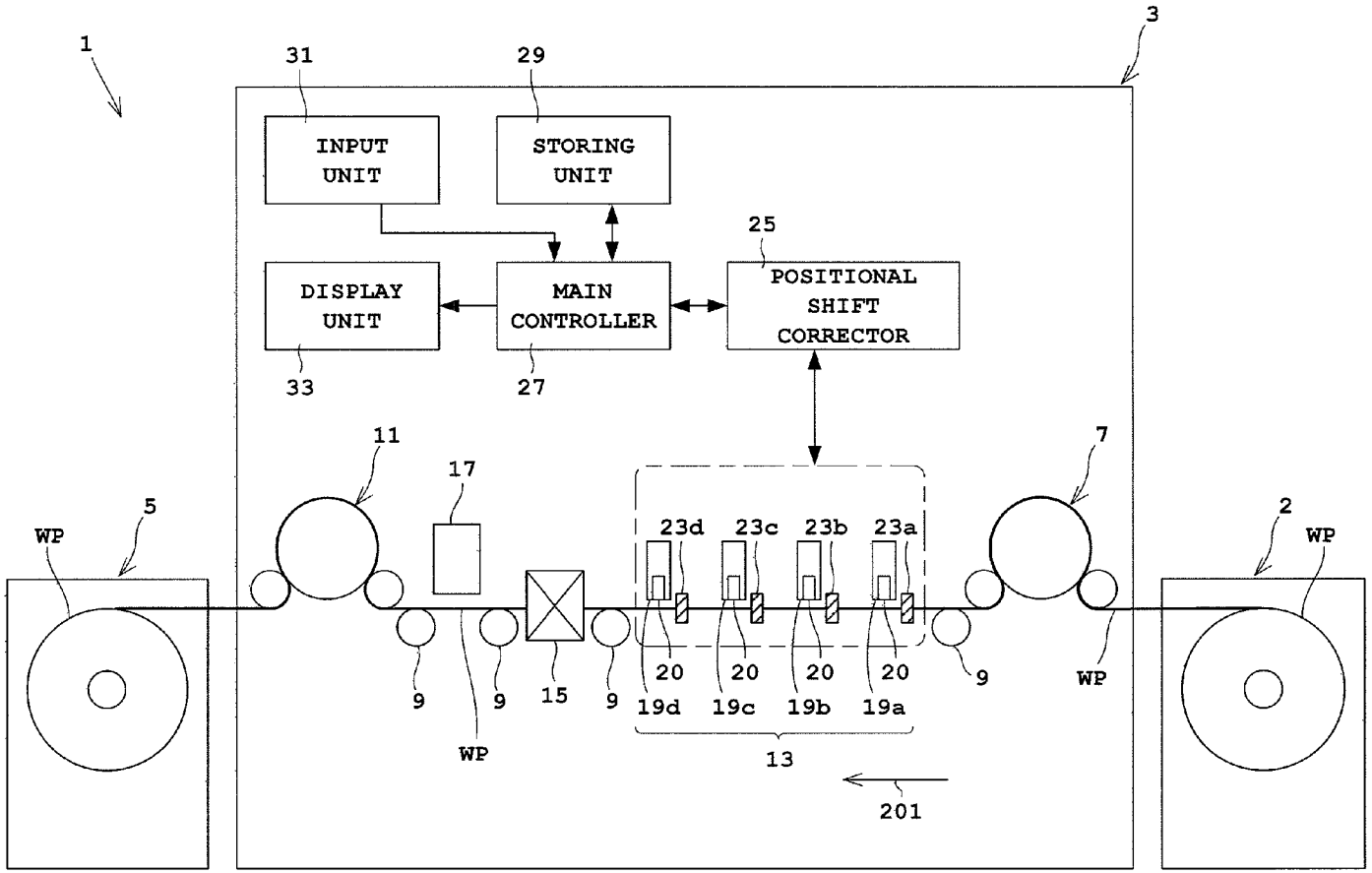
FIG. 2 schematically illustrates an inkjet printing apparatus according to one embodiment of the present invention.
Figure 3:
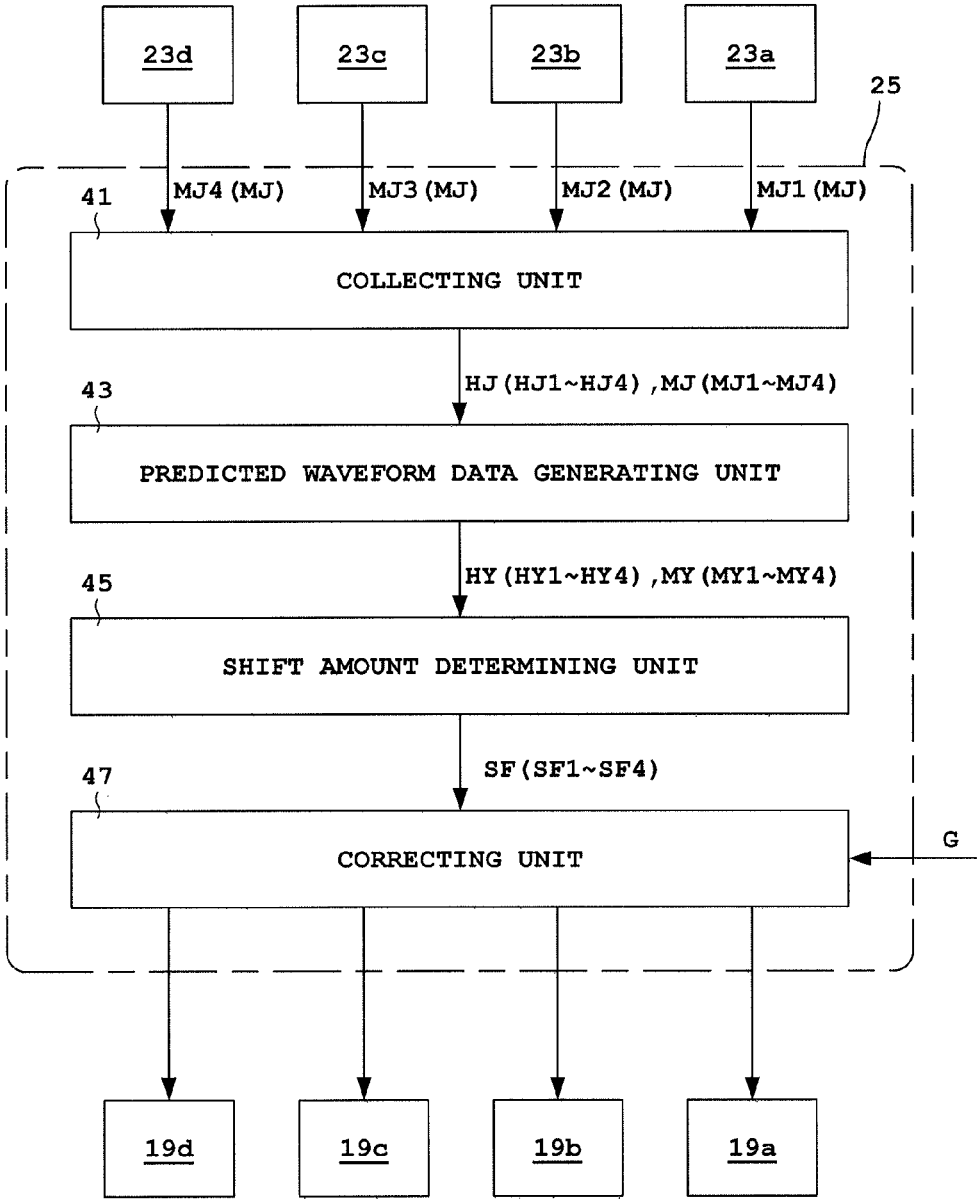
FIG. 3 is a block diagram illustrating a positional shift corrector and control systems therearound.
Figure 4A:
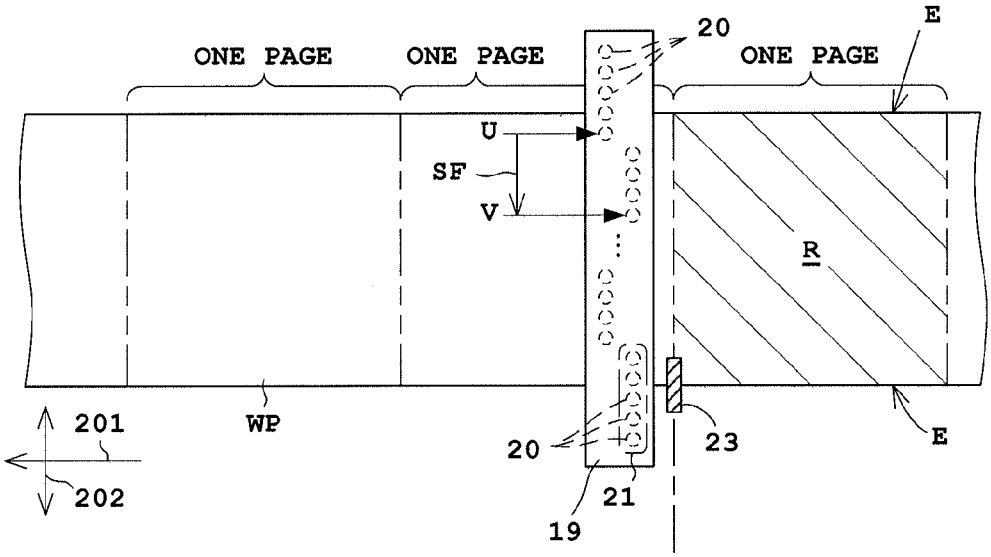
FIG. 4A illustrates web paper, pages of the web paper, a printing head, and an edge sensor when the printing apparatus of FIG. 2 is viewed from above.
Figure 4B:
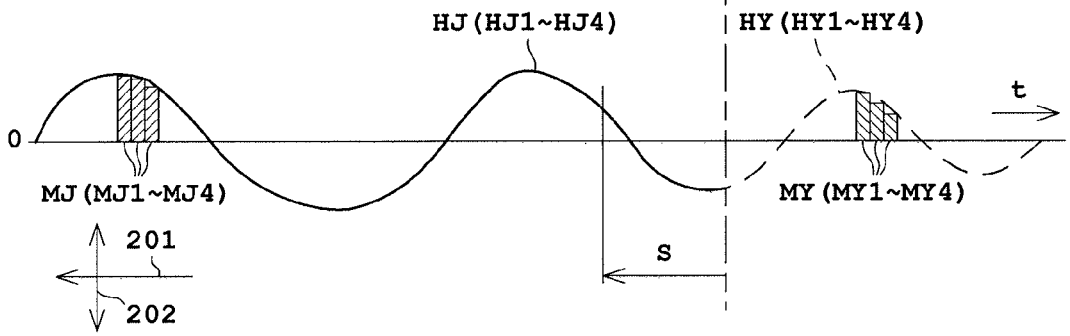
FIG. 4B illustrates a serpentine amount, actually measured waveform data, a predicted serpentine amount, and predicted waveform data.

The following describes one embodiment of the present invention with reference to drawings. FIG. 2 schematically illustrates an inkjet printing apparatus according to the embodiment of the present invention. FIG. 3 is a block diagram illustrating a positional shift corrector and control systems therearound. FIG. 4A illustrates web paper, pages in the web paper, a printing head, and an edge sensor when the printing apparatus of FIG. 2 is viewed from above. FIG. 4B illustrates a serpentine amount, actually measured waveform data, a predicted serpentine amount, and predicted waveform data. Here in the present embodiment, the numeral t denotes time.

<Entire Configuration of Printing Apparatus>

Reference is made to FIGS. 2 and 3. An inkjet printing apparatus 1 includes a paper feeder 2, an inkjet printer 3, and a take-up roller 5.

The paper feeder 2 holds web paper WP in a roll form to be rotatable about a horizontal axis, and unwinds the web paper WP to feed it to the inkjet printer 3. The take-up roller 5 winds up the web paper WP printed by the inkjet printer 3 about the horizontal axis. Regarding the side from which the web paper WP is fed as upstream and the side to which the web paper WP is taken up as downstream, the paper feeder 2 is disposed upstream of the inkjet printer 3 whereas the take-up roller 5 is disposed downstream of the inkjet printer 3.

The inkjet printer 3 includes a drive roller 7 upstream thereof for taking in the web paper WP from the paper feeder 2. The web paper WP unwound from the paper feeder 2 by the drive roller 7 is transported downstream toward the take-up roller 5 along transport rollers 9. A drive roller 11 is disposed between the most downstream transport roller 9 and the take-up roller 5. The drive roller 11 feeds the web paper WP transported on the transport rollers 9 toward the take-up roller 5. Here, the transport rollers 9 are rotatable rollers with no drive mechanism.

The inkjet printer 3 includes a print unit 13, a drier 15, and an inspecting unit 17 in this order from upstream thereof between the drive rollers 7 and 11. The drier 15 dries portions printed by the print unit 13. The drier 15 includes a heat drum (not shown) with a heater embedded therein. The inspecting unit 17 inspects the printed portions for any stains or omissions. Here, the drive rollers 7 and 11 and the transport roller 9 correspond to the transport mechanism in the present invention.

The print unit 13 includes a plurality of printing heads 19 discharging ink individually. The print unit 13 also includes a plurality of (e.g. four) printing heads 19 (19*a* to 19*d*) along a transportation direction 201 of the web paper WP. In the present embodiment, the printing heads 19 are formed by a first printing head 19*a*, a second printing head 19*b*, a third printing head 19*c*, and a fourth printing head 19*d* in this order from upstream thereof. The printing heads 19 are individually spaced away from each other at a given interval in the transportation direction 201.

The printing heads 19*a* to 19*d* discharge ink in at least two colors, and allow color printing onto the web paper WP. For instance, the first printing head 19*a* discharges ink in black (K), and the second printing head 19*b* discharges ink in cyan (C). The third printing head 19*c* discharges ink in magenta (M), and the fourth printing head 19*d* discharges ink in yellow (Y).

As illustrated in FIG. 4A, the printing heads 19 are arranged in a width direction 202 (primary scanning direction) of the web paper WP substantially orthogonal with respect to the transport direction 201 (secondary scanning direction) across the web paper WP. Accordingly, image printing is performable without moving the printing heads 19 in the width direction 202. The printing heads 19 each include a plurality of inkjet nozzles 20 in the width direction 202 for discharging ink. As illustrated in FIG. 4A, the printing head 19 may be formed by nozzle parts 21 with the inkjet nozzles 20, the nozzle parts being arranged in line or in a staggered manner.

The printing apparatus 1 also includes edge sensors 23 (23*a* to 23*d*), and a positional shift corrector 25. The edge sensors 23 each detect a serpentine amount (actually measured serpentine amount) MJ caused by transportation of the web paper WP. The positional shift corrector 25 corrects a positional shift of the image to be printed in accordance with the serpentine amount MJ detected by each of the edge sensors 23. The edge sensors 23 and the positional shift corrector 25 are to be described later in detail. Here, the edge sensors 23 correspond to the serpentine amount sensors in the present invention.

Hereinunder, the printing heads 19*a* to 19*d* are simply referred to as the printing heads 19 if the heads are not particularly distinguished from one another. In addition, the edge sensors 23*a* to 23*d* are simply referred to as the edge sensors 23 if the sensors are not particularly distinguished from one another. The same is applicable to the other components.

The printing apparatus 1 further includes a main controller 27 controlling en bloc the components of the apparatus 1, a storing unit 29 storing image data G to be printed, an input unit 31 used for operator's input setting, and a display unit 33 displaying an operation screen and the like. The main controller 27 is formed by a central processing unit (CPU). The storing unit 29 is formed by a ROM (Read-only Memory), a RAM (Random-Access Memory), or a storage medium such as a hard disk. The input unit 31 is formed by a keyboard, a mouse, a touch panel, and the like. The display unit 33 is formed by a liquid crystal monitor and the like.

<Edge Sensor and Positional Shift Correcting Unit>

The following describes the edge sensors 23 and the positional shift corrector 25 formed by at least either a hardware or a software as characteristic features of the present invention with reference to FIGS. 2 and 3. FIG. 3 is a block diagram illustrating the positional shift corrector 25 and control systems therearound.

The printing apparatus 1 includes the edge sensors 23, a collecting unit 41, and a predicted waveform data generating unit 43. The edge sensors each detect the serpentine amount MJ caused by the transportation of the web paper WP. The collecting unit 41 collects the detected serpentine amount MJ. The predicted waveform data generating unit 43 generates the predicted waveform data HY on the serpentine amount MY to be produced in the following web paper WP in accordance with actually measured waveform data HJ on the detected and collected serpentine amount MJ. The printing apparatus 1 further includes a shift amount determining unit 45 (see FIG. 6) and a correcting unit 47. The shift amount determining unit 45 determines a shift amount SF by which the printing position of the image is shifted in the width direction 202 of the web paper WP, substantially orthogonal to (intersecting) the transportation direction 201 of the web paper WP, in a direction in which the predicted serpentine amount MY is decreased in accordance with the predicted waveform data HY. The correcting unit 47 corrects the printing position of the image in accordance with the shift amount SF and applies a corrected position to the printing heads 19.

The serpentine varies sequentially in its period and its amplitude. Accordingly, it is difficult to print the image to the serpentine web paper WP accurately. For instance, the actually measured waveform data HJ detected with the edge sensors 23*a* and 23*b* in FIG. 2 does not almost agree with each other. Consequently, the misregister and the color shift cannot be suppressed sufficiently through the method in which the shift amount SF is directly determined from the serpentine amount MJ actually detected by the edge sensors 23 (e.g., actually measured waveform data of one period before). With the embodiment of the present invention, the predicted waveform data HY on the predicted serpentine amount MY to be produced in the following web paper WP is generated in accordance with the actually measured waveform data HJ on the serpentine amount MJ, and then the shift amount SF is determined in accordance with the generated predicted waveform data HY. The shift amount SF determined from the predicted waveform data HY causes less misregister or a less color shift than that with the shift amount SF directly determined from the actually measured serpentine amounts MJ. This is to be described hereinafter in detail.

The edge sensors 23 each detect the serpentine amount MJ caused by the transportation of the web paper WP. Specifically, as illustrated in FIG. 4A, the edge sensor 23 detects a serpentine amount MJ at one of longitudinal side edges E of the web paper WP in the transportation direction 201. Here, the serpentine amount MJ corresponds to a variation amount of the web paper WP at the one side edge E in a width direction 202 substantially orthogonal to the transportation direction 201. A transmission type or reflection-type photoelectric sensor having a light emitter and a light receiver is used as the edge sensor 23. As illustrated in FIG. 2, the edge sensors 23 are provided for the four printing heads 19 individually. That is, the edge sensor 23*a* is provided for the printing head 19*a*, and the edge sensor 23*b* is provided for the printing head 19*b*. Moreover, the edge sensor 23*c* is provided for the printing head 19*c*, and the edge sensor 23*d* is provided for the printing head 19*d*.

The following describes determining positions (i.e., setting positions) of the edge sensors 23 in the transportation direction 201. The edge sensor 23*a* detects the serpentine amount MJ at a setting position of the printing head 19*a* or around the position. Specifically, the setting position of the printing head 19*a* is, for example, a setting position of the inkjet nozzles 20. Moreover, the edge sensor 23*a* is disposed at the setting position.

It is preferable that the edge sensor 23*a* detects the serpentine amount MJ at the setting position of the inkjet nozzles 20 of the printing head 19*a* in the transportation direction 201 or around the setting position. That is for determining the shift amount SF1 with the serpentine amount MJ1 detected with the edge sensor 23*a*. However, because of a gap between the printing head 19*a* and the web paper WP, the edge sensor 23*a* is disposed upstream of and spaced away from the printing head 19*a* over the transport path of the web paper WP, as illustrated in FIG. 2. Moreover, the edge sensor 23*a* may be disposed adjoining to the printing head 19*a*. Moreover, the edge sensor 23*a* may be disposed downstream of the inkjet nozzles 20 of the printing head 19*a*.

Determining positions of the other edge sensors 23*b* to 23*d* are each the same as the determining position of the edge sensor 23*a*. Moreover, it is preferable that the edge sensors 23 are formed by the edge sensor 23*a*, the edge sensor 23*b*, the edge sensor 23*c*, and the edge sensor 23*d* in this order from the upstream of the web paper WP in the transportation direction 201. In other words, it is not preferable that the edge sensor 23*a* for the first printing head 19*a* is disposed downstream of the edge sensor 23*b* for the second printing head 19*b*.

The collecting unit 41 in FIG. 3 collects the serpentine amount MJ, i.e., the actually measured waveform data HJ. The collecting unit 41 is formed by a storing unit and the like for storing the serpentine amount MJ obtained with the edge sensor 23. Moreover, the collecting unit 41 collects the actually measured waveform data HJ1 composed of the serpentine amount MJ1 and actually measured waveform data HJ2 composed of a differential serpentine amount MJ2-MJ1, which is to be described later along with operation of the printing apparatus 1.

The predicted waveform data generating unit 43 generates the predicted waveform data HY on the predicted serpentine amount MY to be produced in the following web paper WP in accordance with the actually measured waveform data HJ on the serpentine amount MJ detected with the edge sensors 23 and collected with the collecting unit 41. See FIG. 4B. Here, the actually measured waveform data HJ is time series data on the serpentine amount MJ1. The predicted waveform data HY is time series data on the predicted serpentine amount MY.

Figure 5:
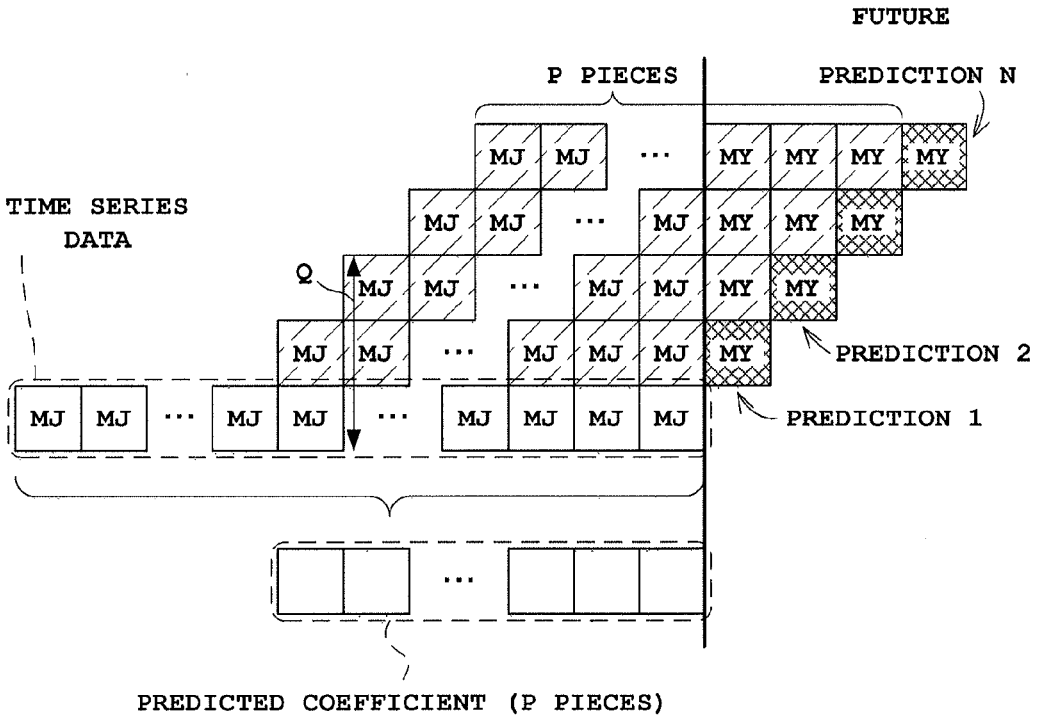
FIG. 5 is an explanatory view of a linear predicting method.

The predicted waveform data HY is generated through a linear predicting method such as a Yule Walker equation. FIG. 5 illustrates the linear predicting method. The predicted waveform data generating unit 43 firstly prepares P coefficients in advance in accordance with the actually measured serpentine amounts MJ. Then, the predicted waveform data generating unit 43 determines a predicted serpentine amount MY of one sample after using the P predicted coefficients and P serpentine amounts MJ. Such a process is repeated to generate predicted waveform data HY. In "prediction 1" in FIG. 5, P actually measured serpentine amounts MJ are used for calculation. In "prediction 2", P−1 actually measured serpentine amounts MJ and one predicted serpentine amount MY determined in the "prediction 1", i.e., total P serpentine amounts are used for calculation. In FIG. 5, cells arranged in a vertical direction denoted by a numeral Q contain the serpentine amounts MJ each having the same numeric values. The same is applied to other line cells.

Here, the predicted waveform data generating unit 43 updates the predicted coefficient for the linear predicting method used upon generation of the predicted waveform data HY every determination of the preset number of serpentine amounts MJ. This allows accurate generation of the predicted waveform data HY. Moreover, the predicted waveform data HY may be generated at a previous timing, such as a timing denoted by the numeral S in FIG. 4B, set in advance for the detected serpentine amount MJ.

The shift amount determining unit 45 determines the shift amount SF by which the printing position of the image is shifted in the width direction 202 of the web paper WP, substantially orthogonal to (intersecting) the transportation direction 201 of the web paper WP, in a direction in which the predicted serpentine amount MY is decreased in accordance with the predicted waveform data HY generated with the predicted waveform data generating unit 43. It is assumed that one page corresponds to an area where one printing object (contents) is included. Under this assumption, the shift amount determining unit 45 determines the shift amount SF in accordance with the predicted waveform data HY, at the shift amount SF a misregister amount being minimized in a page R (see FIGS. 4A and 6) to be printed next. The misregister amount is determined in accordance with the predicted serpentine amounts MY of the entire or partial predicted waveform data HY in one page as a representative value such as an average value or the median of the predicted serpentine amounts MY. The shift amount SF is determined by multiplying the misregister amount by −1. The page R may be next to the page where the edge sensors 23 detects the serpentine amounts MJ, or may be further next.

The correcting unit 47 corrects the printing position of the image in accordance with the shift amount SF determined with the shift amount determining unit 45, and applies the corrected position to the printing head 19. The printing head 19 print the image whose printing position is corrected by the correcting unit 47.

The correcting unit 47 corrects the position by two ways, both of which are adoptable. The following describes the first way. That is, the correcting unit 47 corrects the printing position of the image by shifting the printing position (printing formation position) with the printing head 19 in accordance with the shift amount SF. In other words, as illustrated in FIG. 4A, the correcting unit 47 performs correction such that the ink to be discharged from inkjet nozzles 20 in a given position U is discharged from inkjet nozzles 20 in a position V shifted in accordance with the shift amount SF. Accordingly, the printing position of the image is correctable while the image data G to be printed is kept unchanged.

The following describes the second way. The correcting unit 47 corrects the printing position of the image by changing the positional relationship in the image data G in accordance with the shift amount SF. That is, the correcting unit 47 does not shift the printing position with the printing head 19, but changes the positional relationship in the image data G by editing the image data G to be printed. This achieves correction of the printing position of the image. Here, the correcting unit 47 does not only correct the printing position of the image but also controls a discharging position by fine movement of the printing head 19. Such may be adopted.

<Operation of Printing Apparatus>

The following describes operation of the printing apparatus 1. Firstly, a method of correcting the misregister for the first printing head 19*a* is described, and then a method of correcting the misregister (color shifts) for each of the second to fourth printing heads 19*b* to 19*d* is described.

<Method of Correcting Misregister for First Printing Head 19*a*>

The following describes a method of correcting misregister for the first printing head 19*a* disposed the most upstream side. Reference is made to FIGS. 2 and 3. The edge sensor 23*a* detects a serpentine amount MJ1 caused by transportation of the web paper WP. The collecting unit 41 collects the serpentine amount MJ1.

The predicted waveform data generating unit 43 generates predicted waveform data HY1 after the actually measured waveform data HJ1, i.e., the predicted waveform data HY1 on the predicted serpentine amount MY1 to be produced in the following web paper WP, in accordance with the actually measured waveform data HJ1 on the obtained serpentine amount MJ1 as illustrated in FIG. 4B. Moreover, the predicted waveform data generating unit 43 generates the predicted waveform data HY1 per page. The predicted waveform data HY1 is generated using the linear predicting method (see FIG. 5). This allows determination of the entire or partial predicted waveform data HY1 for pages R to be printed.

Figure 6:
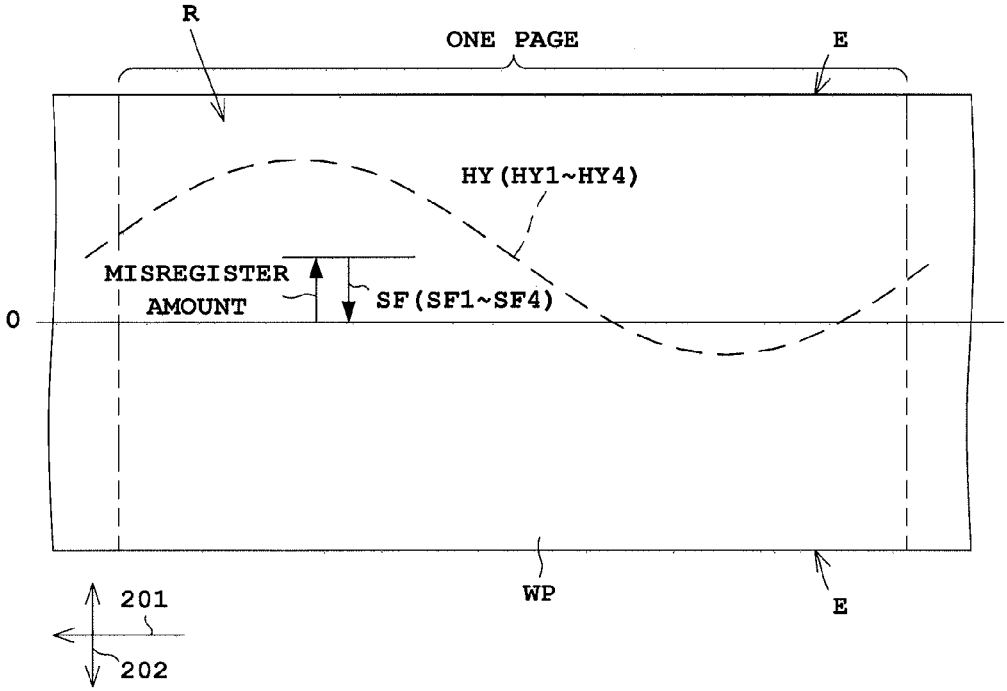
FIG. 6 is an explanatory view of determining a shift amount.

The shift amount determining unit 45 determines the shift amount SF1 by which the printing position of the image is shifted in the width direction 202 of the web paper WP, orthogonal to the transportation direction 201 of the web paper WP, in a direction in which the predicted serpentine amount MY1 is decreased in accordance with the predicted waveform data HY1, as illustrated in FIG. 6. In other words, the shift amount SF1 corresponds to an amount at which the misregister amount is minimized. The misregister amount is obtained by determining an average value of the entire or partial predicted waveform data HY1 in one page of the pages R to be printed.

When the pages R are printed, the correcting unit 47 corrects the printing position of the image to be printed with the printing head 19*a* in accordance with the shift amount SF1, and applies the corrected position to the printing head 19*a*. Here, the shift amount SF1 is constant from start to completion of one-page printing. The same is applicable to the shift amounts SF2 to SF4. The printing head 19*a* discharges ink in black (K) to print the image whose printing position is corrected. This allows suppression of the misregister of the image printed in black (K) with respect to the given position of the web paper WP.

<Method of Correcting Misregister (Color Shift) for Second to Fourth Printing Head 19*b* to 19*d*>

The following describes a method of correcting misregister (color shifts) for second to fourth printing heads 19*b* to 19*d*. The edge sensor 23*b* detects a serpentine amount MJ2 caused by transportation of the web paper WP.

Moreover, the edge sensor 23*c* for the third printing head 19*c* detects a serpentine amount MJ3. The edge sensor 23*d* for the fourth printing head 19*d* detects a serpentine amount MJ4.

The collecting unit 41 collects actually measured waveform data HJ2, mentioned later, so as to suppress a color shift between the image printed with the printing head 19*a* and that printed with the printing head 19*b*. That is, the actually measured waveform data HJ2 is composed of a differential serpentine amount MJ2-MJ1 obtained by calculating a difference between the upstream serpentine amount MJ1 detected with the edge sensor 23*a* upstream in the transportation direction 201 and the downstream serpentine amount MJ2 detected with the edge sensor 23*b* downstream in the transportation direction 201. In other words, the actually measured waveform data HJ2 is composed of the differential serpentine amount MJ2-MJ1 obtained by calculating a difference between the serpentine amount MJ2 detected with the edge sensor 23*b* and the serpentine amount MJ1 detected with the edge sensor 23*a*, other than the edge sensor 23*b*, upstream in the transportation direction.

Moreover, the actually measured waveform data HJ3 used for suppressing the color shift of the image printed with the third printing head 19*c* is composed of a differential serpentine amount MJ3-MJ1. The actually measured waveform data HJ4 used for suppressing the color shift of the image to be printed with the fourth printing head 19*d* is composed of a differential serpentine amount MJ4-MJ1.

The predicted waveform data generating unit 43 generates predicted waveform data HY2 on the predicted serpentine amount MY2 to be produced in the following web paper WP in accordance with the actually measured waveform data HJ2 on the differential serpentine amount MJ2-MJ1. For instance, the predicted waveform data generating unit 43 generates the predicted waveform data HY2 per page. The predicted waveform data HY2 is generated through the linear predicting method. This obtains the entire or partial predicted waveform data HY2 for pages R to be printed.

Similar to the actually measured waveform data HJ2, the predicted waveform data generating unit 43 generates predicted waveform data HY3 on the predicted serpentine amount MY3 to be produced in the following web paper WP in accordance with the actually measured waveform data HJ3 on the differential serpentine amount MJ3-MJ1. Moreover, the predicted waveform data generating unit 43 generates predicted waveform data HY4 on the predicted serpentine amount MY4 to be produced in the following web paper WP in accordance with the actually measured waveform data HJ4 on the differential serpentine amount MJ4-MJ1.

The shift amount determining unit 45 determines a shift amount SF2 in a direction in which the predicted serpentine amount MY2 is decreased in accordance with the predicted waveform data HY2. By the shift amount SF2, the printing position of the image is shifted in the width direction 202 of the web paper WP orthogonal to the transportation direction 201 of the web paper WP. That is, the shift amount determining unit 45 determines the shift amount SF2 at which the misregister amount is minimized. The misregister amount is, for example, obtained by determining an average value of the entire or partial predicted waveform data HY2 in one of the pages R to be printed.

Moreover, similar to the predicted waveform data HY2, the shift amount determining unit 45 determines a shift amount SF3 in accordance with the predicted waveform data HY3, and determines a shift amount SF4 in accordance with the predicted waveform data HY4.

The correcting unit 47 corrects the printing position of the image printed with the printing head 19*b* in accordance with the shift amount SF2, and applies the corrected position to the printing head 19*b*. The printing head 19*b* discharges ink in cyan (C) to print the image whose printing position is corrected. This allows suppression of the misregister of the image printed in cyan (C) with respect to the image printed with the printing head 19*a*.

Moreover, the correcting unit 47 corrects the printing positions of the images printed with the printing heads 19*c* and 19*d* in accordance with the shift amounts SF3 and SF4, respectively. The printing heads 19*c* and 19*d* discharge ink in magenta (M) or yellow (Y), respectively, to print the images whose printing positions are corrected. This allows suppression of the misregister of the images printed in magenta (M) and yellow (Y) with respect to the image printed with the printing head 19*a*.

The predicted waveform data generating unit 43 generates predicted waveform data HY2 on the predicted serpentine amount MY2 to be produced in the following web paper WP in accordance with the actually measured waveform data HJ2 on the differential serpentine amount MJ2-MJ1 obtained by calculating a difference between the serpentine amount MJ2 and the serpentine amount MJ1 as a reference. Here, the differential serpentine amount MJ2-MJ1 is a relative amount of the serpentine amount MJ2 and the serpentine amount MJ1 as a reference. Accordingly, the color shift can be suppressed more easily than with the shift amount SF2 determined only from the serpentine amount MJ2. The same is applicable to the serpentine amounts MJ3 and MJ4.

Figure 7A:
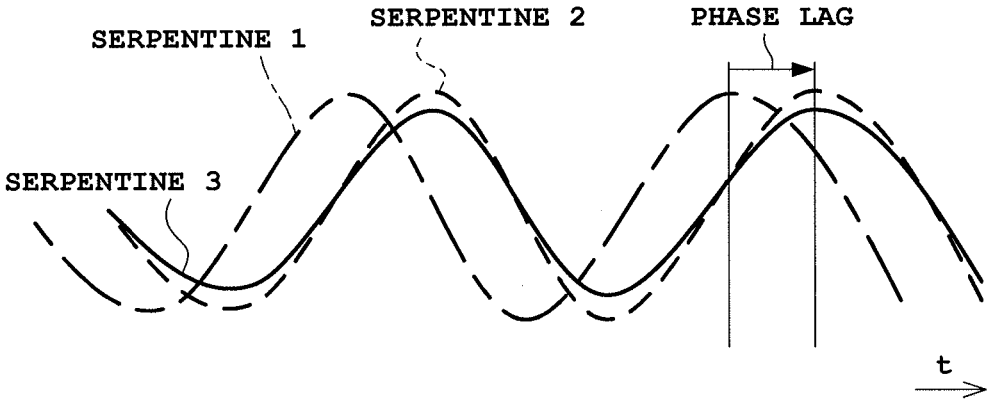
FIGS. 7A and 7B are explanatory views each illustrating an effect through the linear predicting method.

The following describes an effect through the linear predicting method (Yule Walker equation). FIG. 7A is an explanatory view of an effect through the linear predicting method. In FIG. 7A, "serpentine 1" corresponds to the actually measured waveform data HJ on the serpentine amount MJ detected with the edge sensor 23. Moreover, "serpentine 2" corresponds to waveform data on the serpentine amount obtained from the color shift appearing in the image actually printed. It takes 200 ms (mm) until the serpentine amount detected with the edge sensor 23 appears in the printed image. That is, the "serpentine 2" has a phase lag of 200 ms from the "serpentine 1". Here, "serpentine 3" corresponds to predicted waveform data HY obtained by linearly predicting the waveform after 200 ms when a phase lag occurs in the "serpentine 2".

Figure 7B:
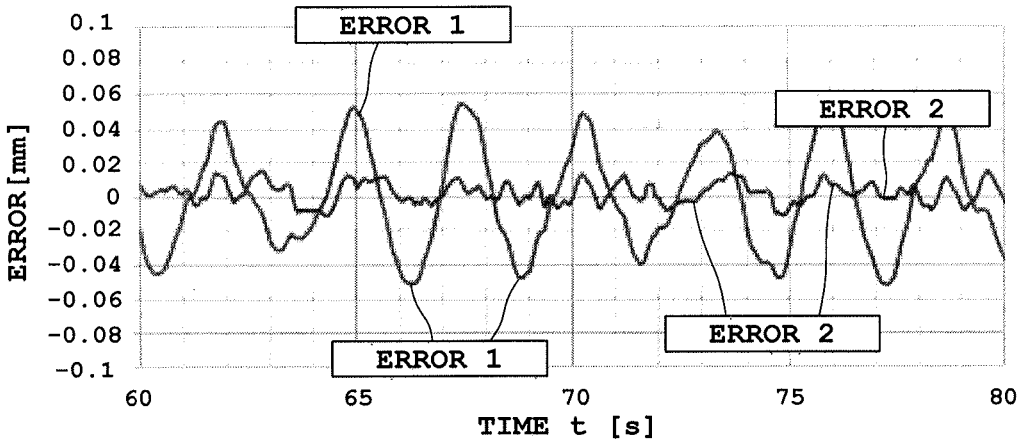

FIG. 7B is a comparative view between errors with no linear predicting and errors with linear predicting. In the drawing, "error 1" indicates an error with no linear predicting and thus indicates an error between the "serpentine 1" and the "serpentine 2" in FIG. 7A. Moreover, "error 2" indicates an error with linear predicting, and thus indicates an error between the "serpentine 3" and the "serpentine 2" in FIG. 7A. It is revealed from FIG. 7B that the "error 2" is approximately 80% less in value than the "error 1" and is close to the serpentine amount actually appearing in the printed image when the linear predicting is conducted. Consequently, the method of predicting the serpentine through the linear predicting method is found effective.

With the present embodiment, the edge sensors 23 detect the serpentine amounts MJ caused by transportation of the web paper. The predicted waveform data generating unit 43 generates the predicted waveform data HY on the serpentine amounts MY to be produced in the following web paper in accordance with the actually measured waveform data HJ on the obtained serpentine amounts MJ. The correcting unit 45 corrects the printing positions of the images in accordance with the shift amounts SF, and applies the corrected positions to the printing heads 19. The shift amounts SF are determined by the shift amount determining unit 45 in accordance with the predicted waveform data HY. This allows determination of the shift amounts SF in accordance with the actually measured waveform data HJ on the serpentine amounts MJ detected with the edge sensors 23 more accurately than those by a method of directly determining the shift amounts. Accordingly, the misregister can be suppressed.

A plurality of printing heads 19 is provided in the transportation direction of the web paper WP, and the edge sensors 23 are provided for the printing heads 19 individually. Since the edge sensors 23 are provided for the printing heads 19 individually, the misregister of the image printed with the printing heads 19 can be suppressed. In addition, a color shift can be suppressed.

Moreover, the predicted waveform data generating unit 43 generates the predicted waveform data HY per page to be printed. Accordingly, the misregister or the color shift can be suppressed per page to be printed.

The present invention is not limited to the foregoing examples, but may be modified as follows.

(1) In the embodiment mentioned above, the four printing heads 19 are disposed. However, another number of printing heads 19 may be adopted. For instance, six printing heads 19 may be disposed. In this case, six edge sensors 23 are provided for the printing heads 19 individually in the transportation direction 201 of the web paper WP. Alternatively, one printing head 19 may be adopted.

(2) In the embodiment and the modification (1) mentioned above, the edge sensors 23*a* to 23*d* detect the serpentine amounts MJ1 to MJ4, respectively. The actually measured waveform data HJ2 is composed of the differential serpentine amount MJ2-MJ1. Moreover, the actually measured waveform data HJ3 is composed of the differential serpentine amount MJ3-MJ1. The actually measured waveform data HJ4 is composed of the differential serpentine amount MJ4-MJ1. Then, the shift amounts SF2 to SF4 are determined in accordance with the actually measured waveform data HJ2 to HJ4, respectively, for correcting the color shifts. However, the actually measured waveform data HJ2 to HJ4 is not limited to the above.

For instance, the actually measured waveform data HJ2 may be composed of the serpentine amount MJ2, the actually measured waveform data HJ3 may be composed of the serpentine amount MJ3, and the actually measured waveform data HJ4 may be composed of the serpentine amount MJ4. In this case, the misregister for each of the serpentine amounts can be suppressed. In addition, when the given positions of the web paper WP each as a reference agree with each other, the misregister can be suppressed to the same degree as the effect of the color shift in the present embodiment.

Moreover, the actually measured waveform data HJ2 may be composed of the differential serpentine amount MJ2-MJ1, the actually measured waveform data HJ3 may be composed of the differential serpentine amount MJ3-MJ2, and the actually measured waveform data HJ4 may be composed of the differential serpentine amount MJ4-MJ3. In this case, the misregister for each of the serpentine amounts can be suppressed. In addition, when the given positions of the web paper WP each as a reference of the serpentine amount MJ1 and the serpentine amount MJ3 agree with each other, the misregister can be suppressed to the same degree as the effect of the color shift in the present embodiment.

(3) In the embodiment and the modifications mentioned above, the actually measured waveform data HJ2 to HJ4 is each formed in accordance with the serpentine amount MJ1. Alternatively, the actually measured waveform data may be formed in accordance with the serpentine amount MJ2. In this case, the actually measured waveform data HJ1 is composed of the differential serpentine amount MJ1-MJ2, and the actually measured waveform data HJ2 is composed of the serpentine amount MJ2. Moreover, the actually measured waveform data HJ3 is composed of the differential serpentine amount MJ3-MJ2, and the actually measured waveform data HJ4 is composed of the differential serpentine amount MJ4-MJ2.

(4) In the embodiment and the modifications mentioned above, the serpentine amount sensor is the edge sensor 23. However, this is not limitative. For instance, the web paper WP contains a line printed in the transportation direction 201, and a serpentine amount is obtained by determining a positional variation of the line in the width direction 202 using a photoelectric sensor. Such is adoptable.

(5) In the embodiment and the modifications mentioned above, the web paper WP is web as a long print medium to be transported. Alternatively, the web paper WP may be a resin (plastic) sheet.

(6) In the embodiment and the modifications mentioned above, the inkjet printing apparatus 1 has been described. Alternatively, other types of printing apparatus printing images onto the web paper WP may be adopted. For instance, an electro photographic printing apparatus may be adopted. In this case, the printing heads in the present invention correspond to a latent image formation unit (not shown). The latent image formation unit forms a latent image by irradiating an electrically charged photoreceptor with laser beams or the like. The latent image formation unit corrects the printing position of the image by changing a timing of writing the latent image with the laser in accordance with the shift amount SF.

The present invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus printing an image onto a web, the printing apparatus comprising:

a transport mechanism transporting the web;

a printing head printing the image onto the web to be transported;

a serpentine amount sensor detecting a serpentine amount caused by transportation of the web at a position where the printing head is disposed or a position therearound;

a predicted waveform data generating unit generating predicted waveform data on the serpentine amount to be produced in the following web in accordance with actually measured waveform data on the detected serpentine amount;

a shift amount determining unit determining a shift amount of a printing position of the image to be shifted in a width direction of the web, intersecting a transportation direction of the web, in a direction in which the predicted serpentine amount is decreased in accordance with the predicted waveform data; and a correcting unit correcting the printing position of the image in accordance with the shift amount and applying a corrected printing position to the printing head.

2. The printing apparatus according to claim 1, wherein a plurality of printing heads is disposed in the transportation direction of the web, and a plurality of serpentine amount sensors is provided for the printing heads individually.

3. The printing apparatus according to claim 2, wherein the actually measured waveform data is composed of differential serpentine amounts obtained by calculating a difference between the serpentine amount detected by one of the serpentine amount sensors and a reference serpentine amount detected with another one of the serpentine amount sensors on either an upstream or downstream side of the one of the serpentine amount sensors in the transportation direction.

4. The printing apparatus according to claim 1, wherein the predicted waveform data generating unit generates the predicted waveform data per page onto which the printing is performed.

5. The printing apparatus according to claim 2, wherein the predicted waveform data generating unit generates the predicted waveform data per page onto which the printing is performed.

6. The printing apparatus according to claim 3, wherein the predicted waveform data generating unit generates the predicted waveform data per page onto which the printing is performed.

7. The printing apparatus according to claim 1, wherein the correcting unit corrects the printing position of the image by shifting the printing position with the printing head.

8. The printing apparatus according to claim 1, wherein the correcting unit corrects the printing position of the image by changing a positional relationship in the image data.

9. A printing method of printing an image onto a web, the printing method comprising:

a serpentine amount detecting step of detecting a serpentine amount caused by transportation of the web by a serpentine amount sensor at a position of printing head or a position therearound;

a predicted waveform data generating step of generating predicted waveform data on the serpentine amount to be produced in the following web by a predicted waveform data generating unit in accordance with actually measured waveform data on the detected serpentine amount;

a shift amount determining step of determining a shift amount of the printing position of the image by a shift amount determining unit in a width direction of the web, orthogonal to a transportation direction of the web, in a direction in which the predicted serpentine amount is decreased, in accordance with the predicted waveform data; and a correcting step of correcting the printing position of the image by a correcting unit in accordance with the shift amount and applying a corrected printing position to the printing head.

* * * * *